United States Patent [19]

Wright

[11] 4,295,231

[45] Oct. 20, 1981

[54] FILIGREED BELT WITH SOLID CENTER PORTION

[75] Inventor: Earl R. Wright, Comanche, Tex.

[73] Assignee: Wright Leather Goods Manufacturing Co., Comanche, Tex.

[21] Appl. No.: 140,314

[22] Filed: Apr. 14, 1980

[51] Int. Cl.[3] ..... A41F 9/00
[52] U.S. Cl. ..... 2/338
[58] Field of Search ..... 2/322, 338, 336, 340, 2/311, 339; 69/2

[56] References Cited

U.S. PATENT DOCUMENTS

| | | | |
|---|---|---|---|
| 2,290,685 | 7/1942 | Hickok | 2/338 |
| 2,427,119 | 9/1947 | Bensel | 2/338 |
| 4,144,594 | 3/1979 | Chapman | 2/338 |

*Primary Examiner*—H. Hampton Hunter
*Attorney, Agent, or Firm*—Arthur F. Zobal

[57] ABSTRACT

A filigreed belt with an outer layer having design openings formed therethrough such that the outer layer has a solid central portion. The design openings and solid center portion extend to the end of the belt opposite the buckle. Openings for the tongue of the buckle are formed through the solid center portion of the outer layer at the end of the belt opposite the buckle.

8 Claims, 4 Drawing Figures

FILIGREED BELT WITH SOLID CENTER PORTION

FIELD OF THE INVENTION

This invention relates to filigreed belts.

DESCRIPTION OF THE PRIOR ART

In recent years, leather products such as belts have been filigreed by removing leather to form various designs in the belts. Generally, the design is formed by cutting leather out around the design, however, the design itself may be removed leaving openings which define the design. Generally the belts are formed of an outer filigreed layer secured to an inner layer with a background layer sandwiched in between.

In the past, the end of the belt opposite the buckle has not been filigreed whereby the outer layer is solid at this end of the belt. Holes are punched through this end of the belt for receiving the tongue of the buckle when the belt is worn by a person. This end of the belt has not been filigreed in the past since in prior belts the design openings have existed at the center section of the belt between its edges and the buckle tongue holes may otherwise be formed within the design openings or at the edge of the design openings resulting in a weakened or blemished belt.

SUMMARY OF THE INVENTION

It is an object of the present invention to provide a filigreed belt having design openings formed such that the belt may be filigreed at the end opposite the buckle without being undesirably affected by the buckle tongue holes.

The filigreed belt comprises an outer layer having design openings formed therethrough such that the outer layer has a center portion free from the design openings. The design openings and center portion extend to the end of the belt opposite the buckle. The buckle tongue hole openings are formed through the belt and hence through the center portion of the outer layer at the end of the belt opposite the buckle.

DESCRIPTION OF THE PREFERRED EMBODIMENT

Figure 1:
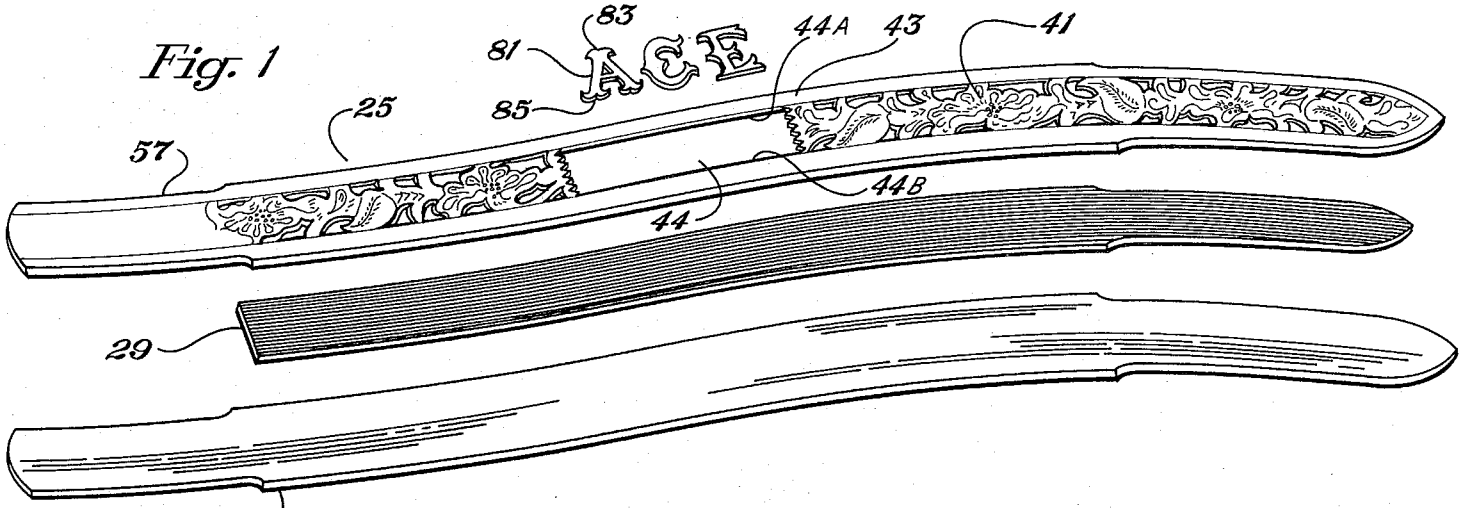
FIG. 1 is an exploded view of a multi-layered filigreed belt incorporating the present invention.
Figure 3:
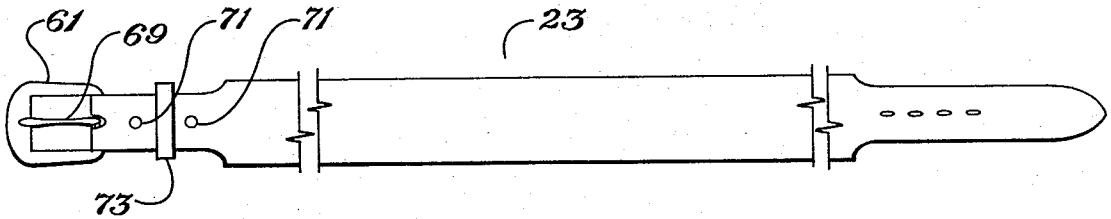
FIG. 3 illustrates a completed belt in outline form.
Figure 2A:
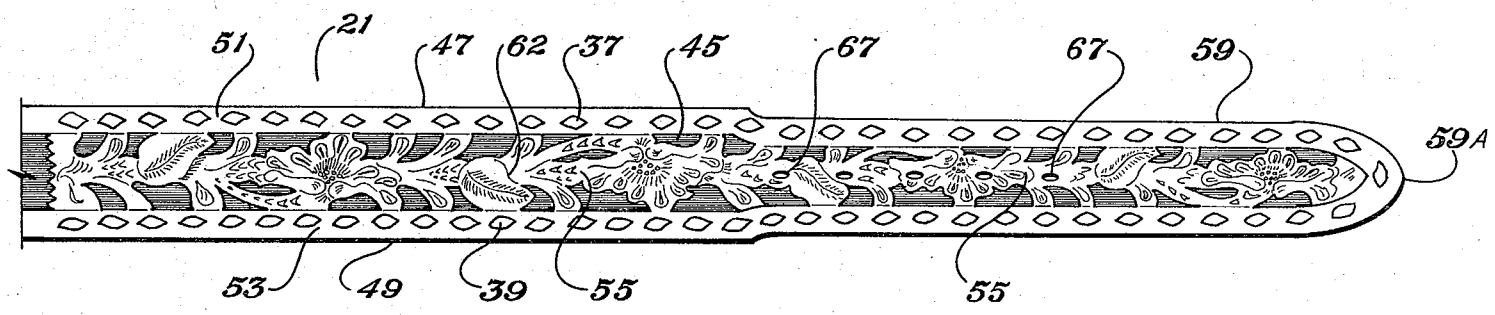
FIGS. 2A and 2B illustrate the filigreed design of the present invention.
Figure 2B:
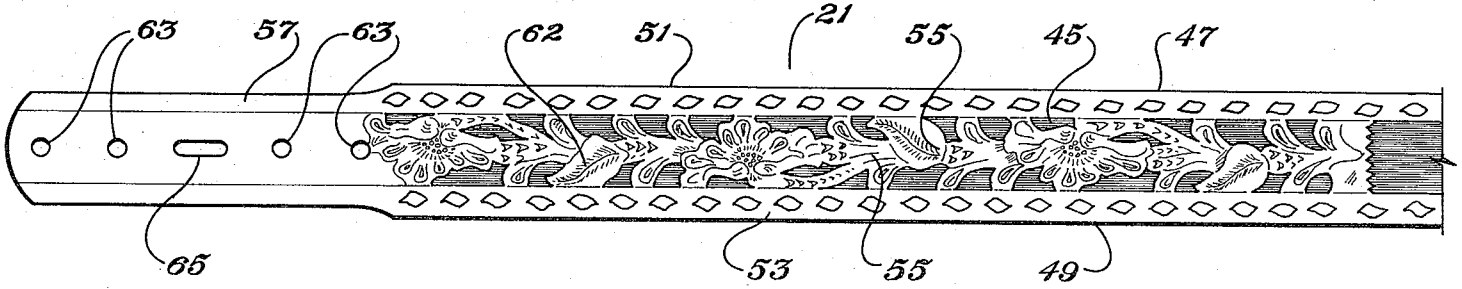

Referring now to FIGS. 2A and 2B, there is illustrated a belt member 21 which is employed to form a belt illustrated in outline form at 23 in FIG. 3. As shown in FIG. 1, the belt member 21 comprises an outer layer 25 attached to an inner layer 27, with an intermediate layer 29 sandwiched therebetween. Layers 25, 27 and 29 are formed of leather with layer 29 being a suede which has a color different from that of layer 25 to form a contrasting background. Layers 25, 27 and 29 are sewn together with two outer rows of stitching (not shown) and two inner rows 37 and 39 of decorative stitching.

The belt member 21 has a name plate with letters formed in a manner to exhibit a filigreed effect. A belt of this type is disclosed and claimed in co-pending U.S. Patent application filed by Jerry Dwain Wright on Oct. 9, 1979, entitled FILIGREED BELT AND PROCESS, Ser. No. 82,870.

In forming the belt member 21, layers 25, 27 and 29 are cut from suitable stock. A design illustrated at 41 is formed in layer 25 leaving a blank intermediate name plate area 43 in which a rectangular shaped opening 44 is formed. The design 41 is formed by removing design openings 45 which are spaced inward from the opposite edges 47 and 49 of the layer 25 whereby the opposite edges 47 and 49 comprise strips 51 and 53 extending along the length of the belt free from the design openings 45. The design openings 45 are spaced outward from opposite sides of a central portion 55 of layer 25 which extends along the length of the belt on opposite sides of the name plate area 43. The central portion 55 is free of the design openings and comprises a solid central portion or strip extending from one side of opening 44 to the buckle end 57 and from the other side of opening 44 to the end 59 opposite the buckle end 57. A short length of the buckle end 57 is left solid for attachment to a buckle 61. The design 41 is formed by the configuration of the design openings 45 and by design lines or marks 62 formed by printing, stenciling or embossing.

After this "filigreeing" has been done the layer 25, layers 25, 27 and 29 are sewn together. The outer stitches (not shown) are sewn through strips 51 and 53 and holes punched in strips 51 and 53 to allow decorative stitching 37 and 39 to be laced through the holes. In addition, holes 63 and 65 are punched through the buckle end 57 and holes 67 punched through the other end 59 at positions such that they extend through the center portion 55. Hole 65 receives the tongue 69 of the buckle 61 and holes 63 receive snaps or rivets 71 which hold the end 57 folded back against itself with the buckle 61 in place as shown and a loop 73 between the two snaps or rivets 71.

Holes 67 receive the tongue 69 of the buckle 61 when the belt is worn by a person. With the design shown, filigreeing can be done practically to the very end 59A of the belt and yet the tongue holes 65 will not extend through the design openings 45 or through their edges thereof. Thus a very attractive belt can be produced with filigreeing done at the end 59 of the belt opposite the buckle end with no weaking or blemishes caused by the tongue holes 67. The design shown is a repeating floral design which alternately faces opposite edges of the belt.

Also provided are precut letters 81 or other indicia adapted to be located in the opening 44 against the suede layer 29 exposed through the opening. The letters 81 are cut from leather stock with a suitable die. Their heights are such that their upper and lower edges 83 and 85 will engage the upper and lower edges 44A and 44B of opening 44 when they are located in the opening. The letters 81 are bonded to the belt with a suitable glue which preferably has an epoxy base. One type of glue that may be used is Bardge All Purpose Cement. Bonding may be carried out by placing the glue on the back sides of the letters 81 and on their upper and bottom edges 83 and 85 and then locating the letters in the opening 44 with their back sides engaging layer 29 and their upper and bottom edges 83 and 85 engaging the upper and bottom edges 44A and 44B of opening 44. In order to facilitate bonding, pressure is applied to the letters for a short period of time with a toggle press. It is important to bond not only the back sides of the letters to layer 29 but also the upper and bottom edges of the letters to the upper and bottom edges of the opening 49 to insure that the letters will be properly secured in place. Where possible, the upper and bottom edges of the letters are cut flat to facilitate bonding.

Although letters 81 have been described as bonded in the opening 44 of the belt, it is to be understood that other indicia such as numbers, symbols, etc., may be employed instead. In FIG. 3, the design 41, opening 44, and letters 81 are not shown for purposes of clarity.

In another embodiment, the name plate area 43 may not have the opening 44 formed therethrough. In this embodiment, the desired letters may be embossed in the area 43 or formed in the area 43 by removing leather from around the letters.

In another embodiment, the name plate area 43 may not be employed whereby the central portion 55 and design may extend along the entire length of the belt.

I claim:

1. A belt to be worn by a person comprising:

an outer layer attached to second layer means, said outer layer facing outward when the belt is worn by a person, design openings formed through said outer layer forming part of a design, said design openings being spaced inward from the opposite edges of said outer layer whereby said opposite edges comprise strips extending along the length of said belt free from said design openings, said design openings being spaced outward on opposite sides of a central portion of said outer layer extending along at least a part of the length of said belt whereby said central portion is free from said design openings, the remainder of said design being formed on said central portion by lines or markings, said belt having a buckle at one end, said design openings and said central portion extending at least to said one end of said belt and to an end opposite said one end, and spaced apertures formed through said belt and hence through said central portion of said outer layer at said end opposite said one end of said belt for receiving the tongue of the buckle when the belt is worn by a person.

2. A belt to be worn by a person comprising:

an outer layer attached to second layer means, said outer layer facing outward when the belt is worn by a person, design openings formed through said outer layer forming part of a design, said design openings being spaced inward from the opposite edges of said outer layer whereby said opposite edges comprise strips extending along the length of said belt free from said design openings, said design openings being spaced outward on opposite sides of a central portion of said outer layer extending along at least a part of the length of said belt whereby said central portion is free from said design openings, the remainder of said design on said central portion being formed by lines or markings, said belt having a buckle at one end, said design openings and said central portion being formed at least at an end of said belt opposite said one end, and spaced apertures formed through said belt and hence through said central portion of said outer layer at said end opposite said one end of said belt for receiving the tongue of the buckle when the belt is worn by a person.

3. The belt of claims 1 or 2, wherein:

said belt is to be worn by a person around the waist.

4. The belt of claims 1 or 2, wherein:

said outer layer is a single strip formed of leather.

5. The belt of claims 1 or 2, wherein:

said outer layer is a single strip formed of leather, said second layer means being formed of leather.

6. The belt of claims 1 or 2, wherein said second layer means comprises:

an intermediate layer and an inner layer, said inner layer being a single strip of material.

7. The belt of claims 1 or 2, wherein:

said second layer means comprises:

an intermediate layer and an inner layer, said inner layer being a single strip formed of leather, said outer layer being a single strip formed of leather.

8. The belt of claims 1 or 2, wherein:

said second layer means comprises:

an intermediate layer and an inner layer, said inner layer being a single strip formed of leather, said outer layer being a single strip formed of leather, said design being a floral design.

* * * * *